US005307306A

United States Patent [19]

Tournois et al.

[11] Patent Number: 5,307,306

[45] Date of Patent: Apr. 26, 1994

[54] WIDEBAND INTERCORRELATION METHOD AND DEVICE IMPLEMENTING THIS METHOD

[75] Inventors: Pierre Tournois, Le Rouret; Daniel Dolfi, Orsay; Jean-Pierre Huignard, Paris, all of France

[73] Assignee: Thomson-CSF, Puteaux, France

[21] Appl. No.: 850,812

[22] Filed: Mar. 13, 1992

[30] Foreign Application Priority Data

Mar. 19, 1991 [FR] France ..... 91 03307

[51] Int. Cl.[5] ..... G06E 3/00

[52] U.S. Cl. ..... 364/822

[58] Field of Search ..... 364/822, 713, 728.03, 364/728.07; 455/600, 601, 156; 359/246

[56] References Cited

U.S. PATENT DOCUMENTS 4,357,676 11/1982 Brown ..... 364/822
4,403,352 9/1983 Huignard et al. ..... 455/601
4,543,662 9/1985 Huignard et al. ..... 455/600
4,864,312 9/1989 Huignard et al. ..... 342/375

FOREIGN PATENT DOCUMENTS 2176281 12/1986 United Kingdom .

OTHER PUBLICATIONS

Electronics Letters, vol. 23, No. 23, Nov. 5, 1987, pp. 1246–1248, P. V. Gatenby, et al., "Broadband Correlators Employing Fibre Optic Recirculating Delay Lines".

*Primary Examiner*—Long T. Nguyen
*Attorney, Agent, or Firm*—Oblon, Spivak, McClelland, Maier & Neustadt

[57] ABSTRACT

An optical architecture enabling the intercorrelation of two instantaneous wideband temporal signals. The beam coming from a monomode laser is used to obtain two carriers (W1, W2) for signals R(t) and S(t) by the use of, for example, integrated optical modulators (mod1, mod2). These two carriers have orthogonal polarizations and are distributed in a 2D structure comprising spatial light modulators as well as polarization separator elements. P×P independent channels (Cl to Cn) are thus formed. Their detection on a matrix of photodetectors (modl to modn) makes it possible to obtain, on each of them, the intercorrelation signal for different delays of the signals R(t) and S(t).

18 Claims, 8 Drawing Sheets

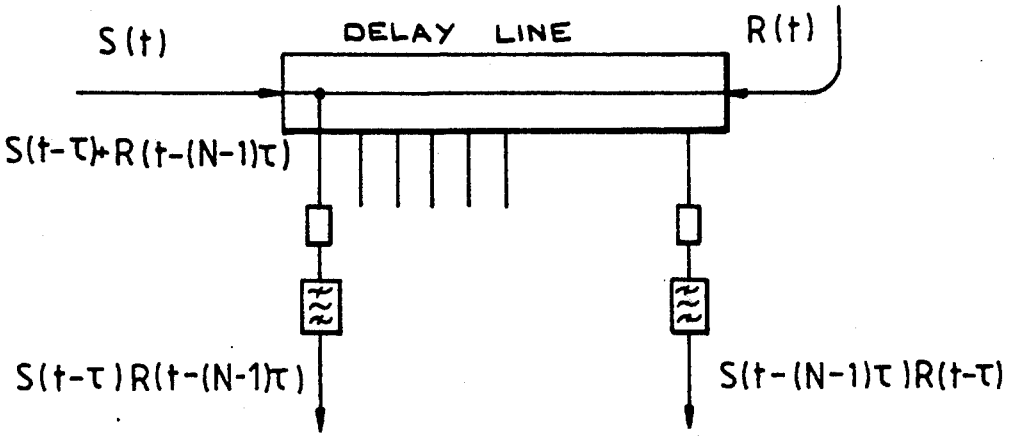
FIG.1
PRIOR ART
FIG.2
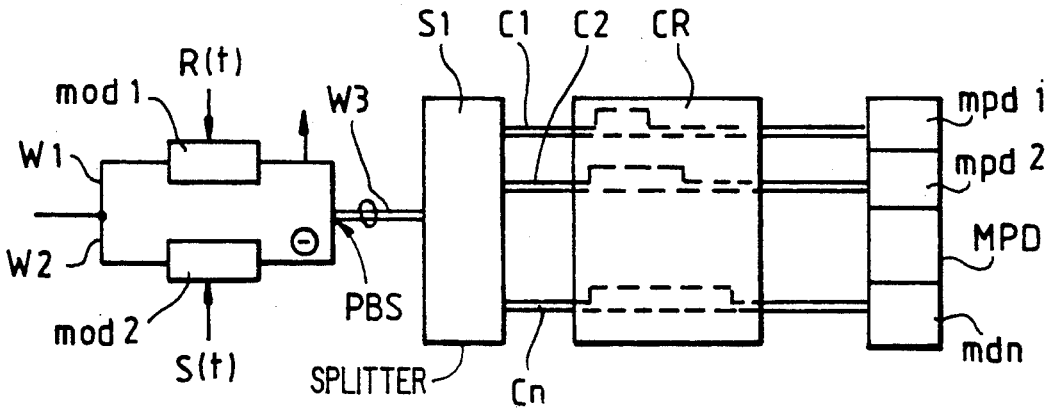

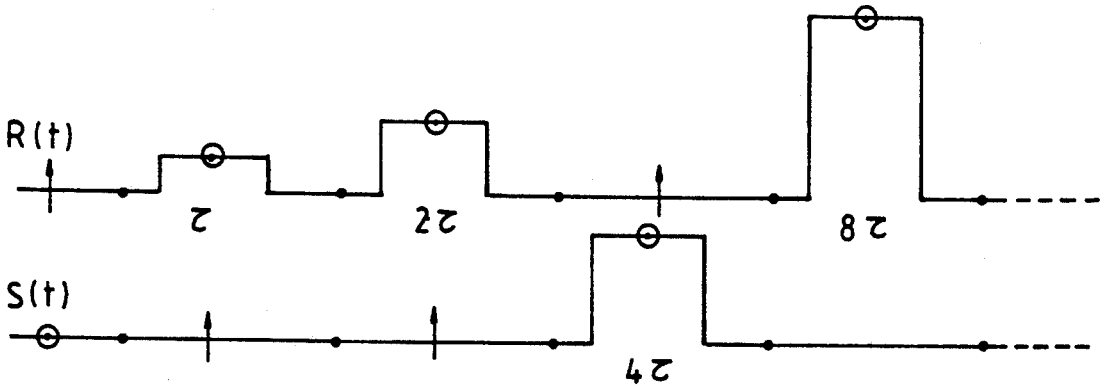
FIG.6
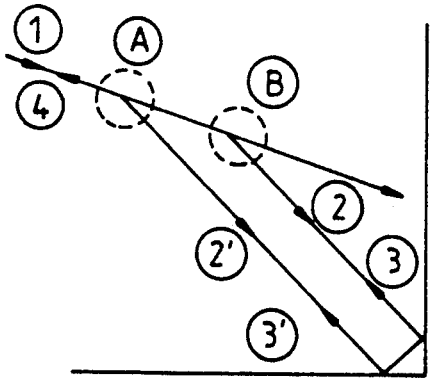
FIG.7
FIG.8
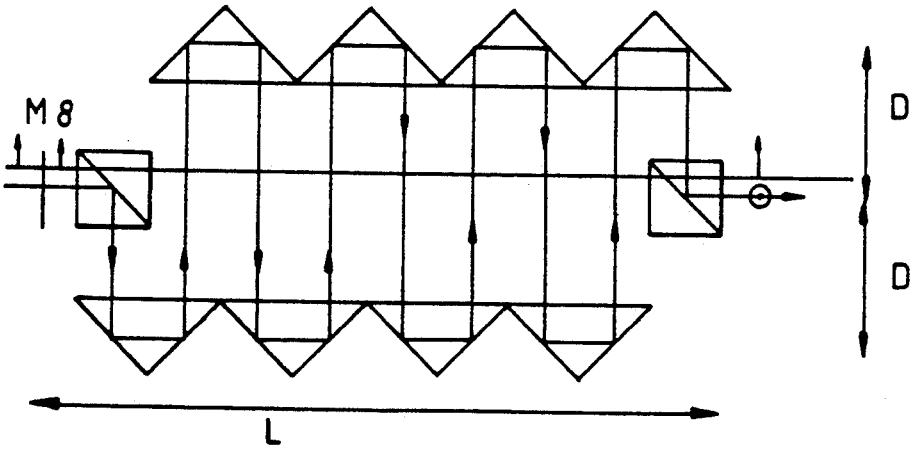

WIDEBAND INTERCORRELATION METHOD AND DEVICE IMPLEMENTING THIS METHOD

BACKGROUND OF THE INVENTION

1. Field of the Invention

The invention relates to a method of wideband intercorrelation and to a device implementing this method.

It can be applied notably to any system such as a system enabling wideband electrical signals to be put into correlation.

2. Description of the Prior Art

In a known way of carrying out such a correlation, signals R(t) and S(t) to be correlated are applied to the two ends of a delay line comprising N coupling points (typically N=128) that are evenly spaced out (FIG. 1). The spacing between two adjacent points corresponds to a time $\tau$ of propagation of the signal S(t). Thus at each of these points, with an index p, it is possible to pick up a fraction of the signal $S(t-p\tau)+R[t-(N-p)\tau]$. Each coupling point is followed by a diode that raises the signal to the second power. A passband filter then enables the isolation, at each output, of the product $S(t-p\tau)\ R[t-(N-p)\tau]$ which is then integrated. The signals S(t) and R(t) may then have an instantaneous band that can cover a 20 GHz band. A band such as this calls for a sampling such that $\tau$ is equal to about 12.5 ps. At present, the number of increments limited to N=128 enables only one correlation on 1.6 ns, to the detriment of an efficient determination of the frequencies contained in the signal.

The method and device of the invention enable operation with a fineness of increments permitting a 20 GHz passband, it being possible to take the number of these increments to N=1 024 or 2 048. This embodiment uses an optical architecture based on 2D spatial light modulators.

SUMMARY OF THE INVENTION

The invention therefore relates to a method for the intercorrelation of electrical signals wherein a first light wave and a second light wave are modulated respectively by a first electrical signal and by a second electrical signal, the two waves being polarized differently and made colinear in a single light beam; then, the light beam is split into at least two channels and, in each channel, a delay is introduced on one polarization with respect to the other; finally, the channels that give the intercorrelation function are detected, and the channel that gives the maximum of the intercorrelation function enables the detection of the delay existing between the first electrical signal and the second electrical signal.

The invention also relates to a device for the intercorrelation of electrical signals comprising at least:

a first electrooptical modulator and a second electrooptical modulator (mod1, mod2) respectively receiving a first electrical control signal and a second electrical control signal as well as a light wave each, with each light wave being modulated by an electrical signal and being polarized along a direction of polarization that is proper to it;

a coupling device (PBS) superimposing the two modulated waves to form a single light beam;

a beam splitter device splitting the light beam into at least two channels;

a switchable polarization rotation device (Ml, Mk) associated with each channel;

a polarization separation device (Bl to Bk) associated with each polarization rotation device and transmitting one polarization on a first path and the other polarization on a second path;

a device for the recombination of the first and second paths towards photodetectors.

BRIEF DESCRIPTION OF THE DRAWINGS

The different objects and characteristics of the invention shall appear more clearly in the following description given by way of an example and in the appended figures, of which:

FIG. 1 shows a delay line device according to the prior art;

FIG. 2 shows a general example of an embodiment of the correlation device according to the invention;

FIG. 6 is a graph of the operation of the device of FIG. 4;

FIG. 7 is a diagram of the operation of a phase conjugation mirror of FIG. 4;

FIGS. 8 and 9 are alternative embodiments enabling the introduction of major delays;

FIG. 13 shows an alternative embodiment wherein only one photodetector is provided for;

MORE DETAILED DESCRIPTION

Referring to FIG. 2, we shall first of all describe a simplified exemplary embodiment of the invention. This device has two electro-optical modulators, modl and mod2, each receiving an optical wave W1 and W2 and each controlled by an electrical modulation signal R(t) for the modulator modl and S(t) for the modulator mod2. The electrical signals S(t) and R(t) are the electrical signals that are to be compared by correlation.

The two modulated optical waves are polarized in different directions (perpendicular for example) and are made colinear in the form of a beam W3.

The beam W3 is split into several channels Cl to Cn, each channel therefore comprising the light polarized by ↑ (the one modulated by R(t)) and the light polarized by ⊙ (the one modulated by S(t)).

The different channels are coupled to a delay creation circuit CR which introduces, into each channel, different lengths of paths for the two polarizations of the channel. The channels are then coupled to photodetectors mpdl to mpdn. The photodetector which detects the maximum intensity corresponds to the channel which introduces a delay enabling compensation for the delay existing between the electrical signals R(t) and S(t).

It is therefore seen that the method of the invention consists in the modulation of two light waves which preferably have the same wavelength, by means of the two electrical signals that are to be put into correlation.

Since the two waves are polarized differently (perpendicularly for example), either before modulation or after modulation, they are made colinear and then the beam obtained is split into several (at least 2) channels. Then, into each channel, there is introduced a determined and known delay which affects one polarization in relation to the other. Finally, all the channels that give the intercorrelation function are detected, and the channel that gives the maximum of the intercorrelation function enables identification of the delay existing between the input signals R(t) and S(t).

Figure 3:
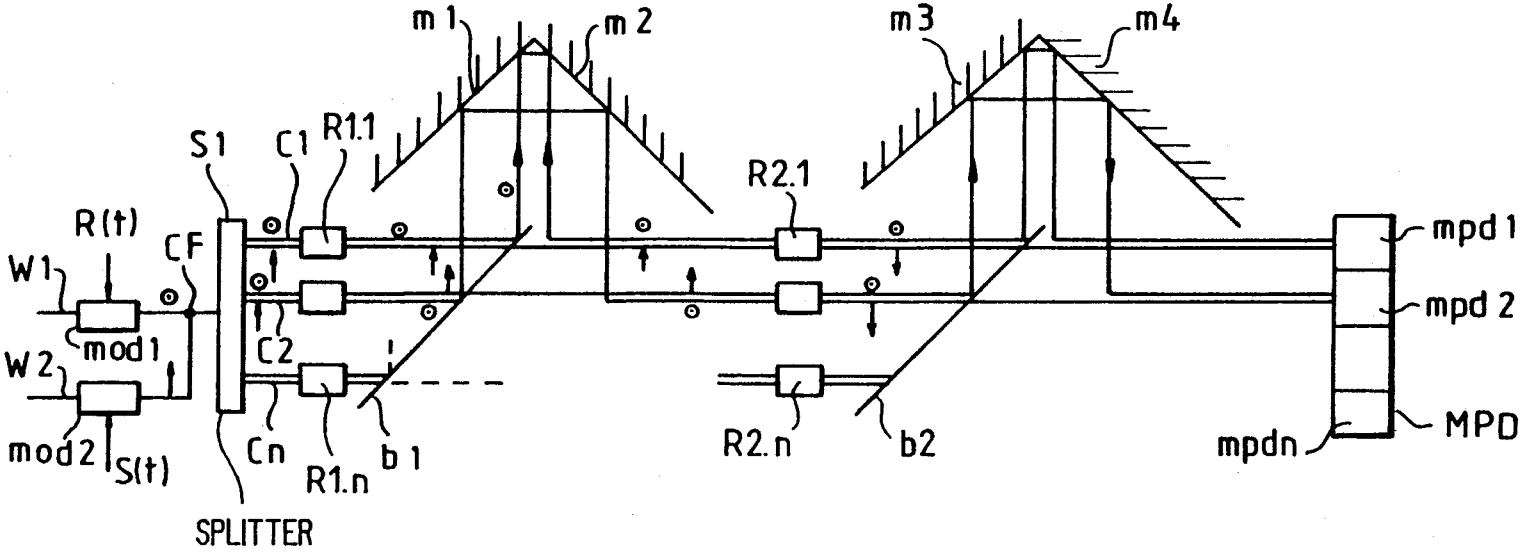
FIG. 3 shows a detailed example of an embodiment of the correlation device according to the invention.

FIG. 3 shows an exemplary embodiment of the device of the invention. It has modulators mod1 and mod2. A coupler CF combines the two waves that are modulated and polarized perpendicularly. A beam splitter Sl splits the beam obtained into several channels. Switchable polarization rotation devices Rl.l to Rl.n cause the rotation, as desired and by 90°, of the directions of polarization contained in the different channels A first polarizer bl reflects a determined polarization from each channel and transmits the other one. Then, the reflected polarization is made colinear, by mirrors m1, m2 and a coupler, with the transmitted polarization. One polarization is therefore delayed with respect to the other one in each channel. A second set of polarization rotation devices R2.l to R2.n, a polarizer G2 and mirrors m3, m4 perform a similar function. Then the different channels are coupled to photodetectors mpdl to mpdn.

As can be seen in FIG. 3, if the polarizations of the channel Cl are considered, one of the polarizations is delayed by the first delay circuit and then by the second delay circuit. If each circuit contributes a delay with a value t, the two polarizations are liable to be delayed by 2t on reaching the photodetector MPDl, in assuming that they were synchronous at the outset, i.e. that the signals R(t) et S(t) were in phase.

For the channel C2, one of the polarizations is delayed in the first delay circuit while it is the other polarization that is delayed in the second delay circuit. The phase relationship between the two polarizations is therefore preserved.

It is seen that, by increasing the number of delay circuits, an increase is achieved in the number of possible delays between the polarizations. In this way, the possibilities of compensations of delay to be detected are increased.

Figure 4:
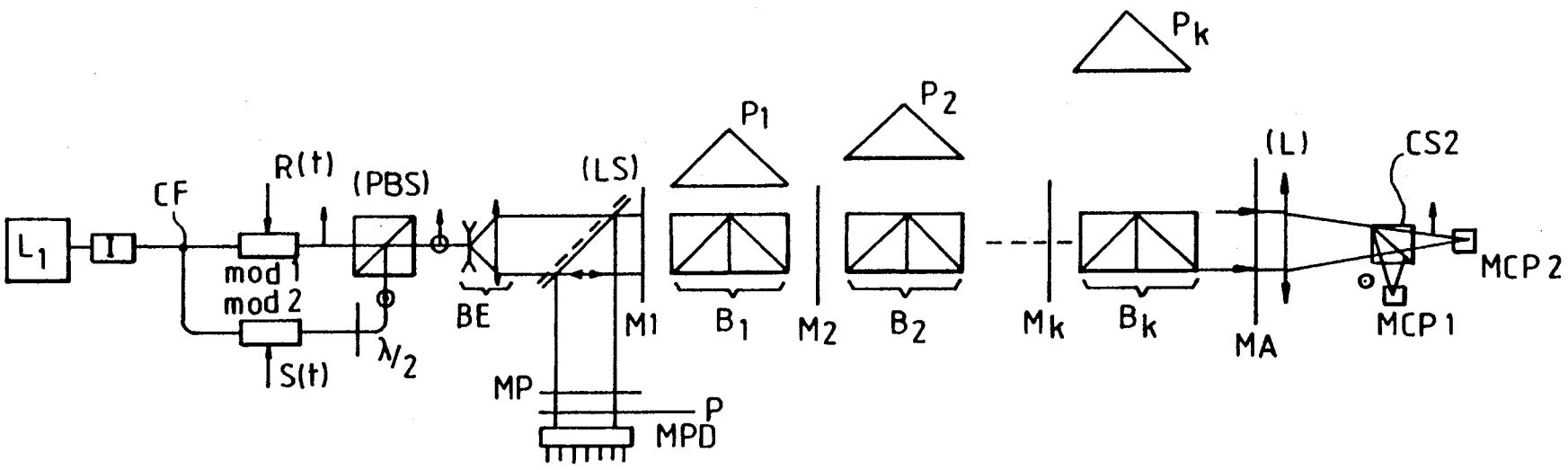
FIG. 4 shows a more detailed example of an embodiment of the correlation device according to the invention.

Referring to FIG. 4, we shall now describe a detailed example of an embodiment of the invention.

The polarized beam coming from a laser $L_1$ goes into an isolator I and is then split into two by means of a beam splitter, for example a coupler with fibers CF. One part goes into a modulator of intensity modl excited by the signal R(t). There is thus available, at output of this modulator, an optical carrier whose intensity is modulated by R(t). In the same way, the other part of the beam is modulated in mod2 by S(t). Mod1 and mod2 are, for example, optical modulators integrated on $LiNbO_3$ or semiconductor material. The performance characteristics of modulators such as these indeed permit passbands ranging from 0 to 20 GHz and a dynamic range compatible with wideband signals to be processed. The polarizations of the two beams thus modulated are made orthogonal (FIG. 4). However, the polarization of the beams may also be done before modulation. Then the two beams are superimposed by means of a coupler such as a polarization separator cube PBS, and then extended by an a focal system BE so as to cover a spatial light modulator $M_1$. This modulator is, for example, a liquid crystal cell having P ($P \approx 1024$) pixels. Each pixel of the modulator $M_1$ determines a channel of light. The spatial modulator $M_1$ is positioned in such a way that it divides the extended laser beam into P parallel channels. On each pixel, the polarization of the incident light is rotated by 0° to 90° depending on the voltage applied. It may be noted that only two states (0° and 90°) are necessary and that, therefore, ferroelectric liquid crystal cells are quite appropriate.

Figure 5A:
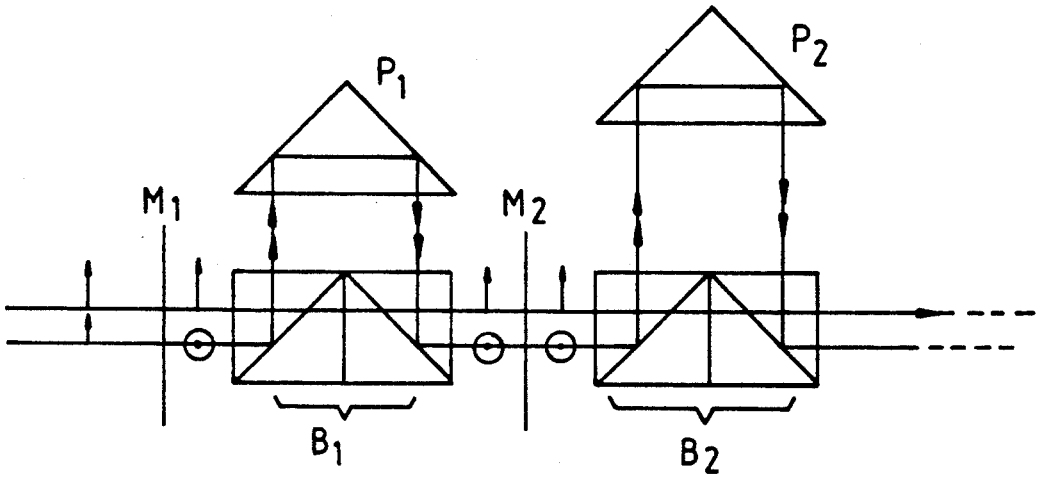
FIGS. 5*a*, 5*b* show exemplary embodiments of the circuits achieving delays.

A set of polarization separator cubes and total reflection prisms is placed at the output of the modulator. As can be seen in FIG. 5*a*, the choice of the state of polarization on the modulator $M_1$ enables the choice, for each channel (pixel), of the path followed by each of the two polarizations.

The position of the prism $P_1$ (FIG. 5*a*) is adjusted in such a way that the difference in optical path between the two othogonal polarizations of a channel corresponds to a delay with a value $\tau$. The assembly constituted by the spatial modulator $M_1$, the polarization separator cube Bl and the reflection devices Pl therefore constitute a delay creation system. Several delay creation systems thus designed are positioned in series. For example, in the second delay creation system, the position of $P_2$ is chosen to give a delay $2\tau$; that of $P_1$ is chosen for a delay $2^{l-1}\tau$. With the delay creation system, $2^k$ possible delay values are thus available for the two polarizations $(0,\tau,2\tau, \ldots, 2^k\tau)$.

The different modulators $M_1$ to Mk are identical and are aligned so that the different pixels of the modulators are aligned on the optical paths of the different channels.

If the carrier of the signal R(t) is ↑ polarized at the input of the delay structure, then that of S(t) is ⊙ polarized. Thus, if attention is paid to one channel in particular, it is seen that the paths followed by the two polarizations are necessarily complementary to each other from the viewpoint of delays (FIG. 5). Indeed, on each spatial modulator $M_1$, the two orthogonal polarizations ↑ and ⊙, going through the same pixel, undergo the same value of rotation of polarization (⊙ remains ⊙ when ↑ remains ↑). On the contrary, ⊙ becomes ↑ when ↑ is changed into ⊙. It is thus seen, in the example of FIG. 6 of a structure giving a maximum delay of $15\tau$ (for example), that the carrier R(t) undergoes a delay $11\tau$ whereas the carrier S(t) undergoes a delay of $4\tau$. More generally, for a device giving a maximum delay $N\tau$, when the carrier of R(t) undergoes a delay pr on a channel then, on the same channel, the carrier S(t) undergoes the complementary delay $(N-p)\tau$.

When the two carriers of R(t) and S(t), divided into P parallel channels, have crossed the delay structure, they pass into a spatial modulator MA controlling the transmitted intensity $a_p$ on each of the channels. This 2D modulator may, for example, be a liquid crystal cell placed between polarizers.

An optical system L then provides for the focusing of all these parallel channels on a set of two phase conjugation mirrors $MCP_1$ and $MCP_2$. These two mirrors are preceded by a polarization separator cube CS2. $MCP_1$ is illuminated by the polarization ⊙ while $MCP_2$ receives only the ↑ polarized beams. MCP1 and MCP2 may be, for example, photorefractive crystals of barium titanate $BaTiO_3$. Each phase conjugation mirror is said to be self-pumped for it is the incident waves alone that create the photoinduced arrays from which the conjugated waves will be created. In the simple case of a single incident wave, the creation of a conjugated wave is shown schematically in FIG. 7 and is described in the document by J. FEINBERG, Optics Letters, 2, 486, 1982:

in the region B, the incident beam 1 gives rise to the beam 2 owing to scattering on microfaults of the crystal;

the beam 2, twice reflected by the dihedron formed by the two faces of the crystal, gives 3';

furthermore, in the region A, the beam 1 gives rise to 2', also by scattering. 2' follows the path of 3' in reverse and, after reflection on the dihedron, gives the beam 3;

the interaction 1, 2, 3 in the region B, as well as that of 1, 2', 3' in the region A, gives rise to the beam 4 by a mixing of four waves. This beam is moreover the phase-conjugated replica of 1.

For each polarization, the set of channels coming from the modulator MA is thus phase conjugated. The use of $BaTiO_3$ makes it necessary to prepare polarizations on $MCP_1$ and $MCP_2$ for this crystal is sensitive only to one polarization.

After conjugation, the two polarizations are superimposed again by the separator cube CS2. The beam thus reconstituted, having the same characteristics as the incident beam but being propagated in the reverse direction, again goes through the different delay creation systems. One part, extracted by the semi-reflecting plate (LS), is directed towards a phase modulator MP having the same number of pixels as there are channels and as there are pixels in the modulators Ml to Mk. After passing through MP, the P channels resulting from division by the modulators are detected by a matrix MPD of P photodetectors. A polarizer has furthermore been placed before MPD. This polarizer is oriented by 45° with respect to the directions ⊙ and ↑ and provides for their recombination in a single direction of polarization. On each channel and, therefore, on each MPD detector (FIG. 4), it is thus possible to make a coherent detection of the carriers of the signals R(t) and S(t).

By means of the a focal system BE, it is an almost plane wave that goes through the delay structure towards $MCP_1$ and $MCP_2$. The phase compensation provides for the exact compensation of all the phase defects encountered by this wave. It is therefore a plane wave that emerges from the structure after passing twice through it, and gets reflected on (LS). This conjugation does not, however, compensate for the defects which are of another magnitude. Indeed, for each channel, we can write:

$$p.c.\tau = Kp.\lambda + r_p\lambda$$

where:

.λwavelength of $L_1$ $Kp \epsilon N$ $0 < r_p < 1$

It is the fraction $r_p\lambda$ that will be compensated for by phase conjugation. Furthermore, given the respective values of λ and t, we have $Kp >> r_p$. The photocurrent given by the detector corresponding to pr is thus:

$$i_p(t) \alpha \left[ S_1(t - 2p\tau)\exp j\omega \left( t - 2K_p \frac{2\pi}{\omega} \right) + S_2(t - 2(N-p)\tau)\exp j\omega \left( t - 2K_{N-p} \frac{2\pi}{\omega} \right) \right]^2$$

where this relationship takes account of a mean in the response time of the detector. Provided that the length of coherence of $L_1$ is greater than the greatest difference in step between the carriers R(t) and S(t), we have:

$$i_p(t) \alpha |R(t - 2p\tau)|^2 + |S(t - 2(N-p)\tau|^2 + 2R(t - 2p\tau)S(t - 2(N-p)\tau)\cos 4\pi(K_p - K_N) = |R(t - 2p\tau)|^2 + |S(t - 2(N-p)\tau|^2 + 2R(t - 2p\tau)S(t - 2(N-p)\tau)$$

The fact of passing twice through the structure doubles the value of the delays fixed by the position of the prisms $P_i$ ($\tau \rightarrow 2\tau$). Applying the strictest methods, it is not $S_1$ ($t - 2p\tau$) but $S_1$ ($t - 2K_p\lambda/C$) that is considered. Furthermore, even if $MCP_1$ and $MCP_2$ compensate for the phase differences greater than $2\pi(r_p > 1)$, these differences are equal to not more than a few units and do not affect the value p.τ. The spatial modulators of amplitude MA and of phase MP make it possible, when there are no modulations R(t) and S(t), to obtain a detected signal level that is uniform throughout MPD:

the amplitude modulator MA, by controlling the amplitude, makes it possible to compensate for the differences in coefficient of transmission on the different channels (the dioptre number encountered is not the same whatever the value of the delay) as well as the differences in the coefficient of reflection of the $MCP_1$ and $MCP_2$ (as a function of the incidence). This modulator may be a liquid crystal cell made by means of a twisted nematic liquid crystal between polarizers;

MP acts on the respective phases of the two polarizations recombined on P. Action is taken on the phase of ⊙, for example, as a function of the voltage applied to the pixel, without affecting ↑.

This phase modulator therefore makes it possible to check solely the amplitude of the product R(t) and S(t).

Each photodetector of MPD is followed by an integrator. The integration time T is necessarily greater than the maximum delay 2Nτ.

After integration, each channel gives a signal $C_P(T)$ such that:

$$C_p(T) = R(T) + S(T) + \frac{2}{T} \int_T R(t - 2p\tau)S(t - 2(N-p)\tau)dt$$

$$C_p(T) = R(T) + S(T) + \frac{2}{T} \int_T R(t' - 4p\tau)S(t' - 2N\tau)dt'$$

where:

$$R(T) = \int_T |R(t-2p\tau)|^2 dt = \int_T |R(t-4p\tau)|^2 dt = \dots = \int_T |R(t-2N\tau)|^2 dt$$

and:

$$S(T) = \int_T |S(t-2p\tau)|^2 dt = \dots = \int_T |S(t-2(N-p)\tau)|^2 dt$$

The term R(t)+S(t) is common to all the channels. These are differentiated only by:

$$C_p = \frac{2}{T}\int_T R(t'-4p\tau)S(t'-2N\tau)dt'$$

which, except for a difference of origin, is truly the desired correlation signal. The desired correlation function is thus truly achieved on P channels, in taking advantage of the parallelism of the 2D optical architecture. The determining of the signal with the highest amplitude gives the center of the intercorrelation function which determines the value of the delay existing between the two electrical signals R(t) and S(t).

As an example of an embodiment, the device of FIG. 4 is made with components that may have the following characteristics:

$L_1$:
* longitudinal monomode, diode-pumped solid-state laser, some 100 mW, $\lambda = 1.3\ \mu m - 1.5\ \mu m$ $mod_1$, $mod_2$:
* Optical modulations integrated on $LiNbO_3$
* Wideband 0→20 GHz
* Depth of modulation: 80 to 100%
* Insertion losses: ≈6 dB $M_i$:
* twisted nematic or ferroelectric liquid crystal cells, $40\times40\ mm^2$
* 32×32 pixels controlled individually
* rate of extinction between crossed polarizers : 1 : 1000 (compatible with the dynamic range required for the correlation)

MA:
* cell identical to the preceding cells $M_i$ but placed between crossed polarizers

- MP:
* parallel nematic liquid crystal cell. The axes of the cell coincide with the polarizations ⊙ and ↑

Figure 5B:
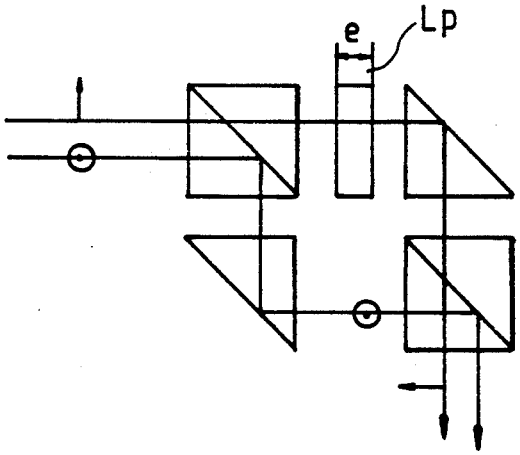

MPD:
* matrix of fast photodiodes+integrator
* depending on the necessary integration times, the assembly formed by the photodiodes and the integrator may be replaced by a CCD detector Value of the delays:
* for a 20 GHz passband →$2\pi$=25 ps.
* 1024 increments are necessary for a correlation with a dynamic range of 30 dB. The architecture therefore includes 10 modulators $M_i$.
* for the lower increments (25 ps→1 mm), FIG. 5*b* gives an exemplary embodiment: a plate Lp with a thickness e gives the difference in step between the two polarizations ($\tau$=en/c)
* thus, when $\tau$=12.5 ps, e=2.5 mm. The same is the case for 2$\tau$, 4$\tau$ and 8$\tau$. The respective thicknesses are 5 mm, 10 mm and 20 mm. Starting from 16$\tau$=200 ps and up to 128$\tau$=1600 ps, the drawing of FIG. 5*a* remains usable. For the latter value, the distance between $P_7$ and $B_7$ is 0.4 m. For the two highest values 256 $\tau$ and 512 $\tau$, it is necessary to make the configuration of FIG. 8 which enables a folding of the optical paths. For a 32×32 mm matrix, L≈300 mm.

256 $\tau$ $D$ = 5 cm
512 $\tau$ $D$ = 10 cm

The total length of the device is then about 1.2 m (700 mm for the first eight stages, 300 mm for the last two stages), its width is 0.3 mm. Its thickness may be not more than 40 mm, thus enabling a folding of the entire device on two superimposed layers with a total volume ≈12 liters). It may be noted that for a number of delays equal to 128 (instead of 1024), the dimensions are $400\times600\times40\ mm^3$.

A device such as this has the following advantages:

It enables the correlation of wideband signals.

The correlation signals are obtained in parallel on P channels.

A checking of the amplitude of each channel enables compensation for the dispersal of the levels. It further enables the dynamic range of the signals received to be matched with that of the photodetectors.

The proposed architecture can be entirely reconfigured at each instant. The value of the delay increment may thus be permanently matched with the band of a received signal.

A number of channels greater than that of the delays permits the malfunctioning of certain pixels without any effect on the performance characteristics of the system (the same is true for the photodiodes).

The phase conjugation mirrors make it possible to compensate for all the phase distortions introduced by the optical carrier without thereby in any way affecting the precision with which the microwave delays are determined. This conjugation further makes it possible to do without optical systems in which the spatial modulators $M_1$ image each other and which would otherwise have been made necessary by the diffraction of the pixels.

Figure 9:
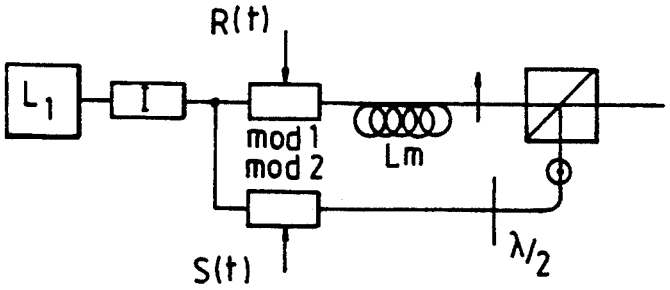

FIG. 9 shows an alternative embodiment of the device of the invention.

In the case of a system where a minimum delay has already been planned, the memorizing of this delay is provided by a fiber length $L_M$ at the output of a modulator, $mod_1$ for example (FIG. 9). The rest of the architecture remains identical. The fiber $L_m$ thus enables the values of delays given by the architecture to be "centered" on a value corresponding to the mean range of the system.

Figure 10:
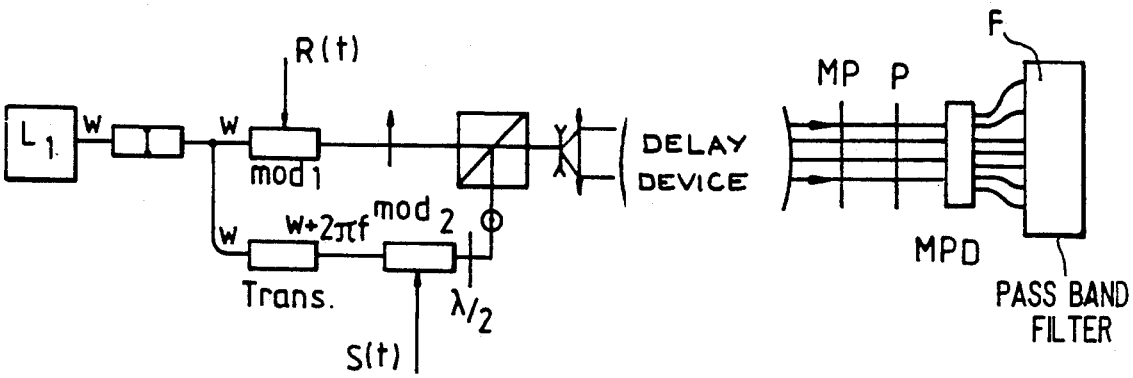
FIGS. 10 and 11 show an alternative embodiment incorporating a frequency translator.

FIG. 10 shows another alternative embodiment of the device according to the invention.

In this alternative embodiment, the proposed architecture works with a single passage, without phase conjugation, by means of a frequency shift between the carriers of the signals R(t) and S(t).

A frequency translator Trans modifies the frequency of the laser beam passing into the modulator $mod_2(\Omega$ becomes$\Omega+2\pi f)$. This translation is one with a fixed frequency and a constant level. The two carriers of R(t) and S(t) remain orthogonally polarized. After having recombined, they go through the same delay device as the one described in FIG. 4. The set of channels thus separated goes through a phase modulator MP, the working of which has been described here above. It is followed by a polarizer P polarizing at 45° with respect to ⊙ and ↑, then by a matrix of fast photodiodes. Each photodiode will therefore give a photocurrent with the form:

$$i_p(t)\alpha < [S_1(t-p\tau)\exp j\omega(t-p\tau) + S_2(t-(N-p)\tau)\exp j(\omega'(t-(N-p)\tau)+\phi_p)]^2 >$$

where $\phi_p$ is controlled by $M_p(\omega'=\omega+2\pi f)$ $$i_p(t)\alpha < [S_1(t-p\tau)]^2 > + < [S_2(t-(N-p)\tau)]^2 > + 2\,S_1(t-p\tau)S_2(t-(N-p)\tau)\cos(2\pi ft + \underbrace{\omega p\tau - \omega'(N-p)\tau + \phi_p}_{\phi_p})$$

The phase $\phi_p$ depends on the position of the prisms, but its value cannot be fixed on an a priori basis since the precision required on their positioning is in the range of λ, wavelength of $L_1$.

Figure 11:
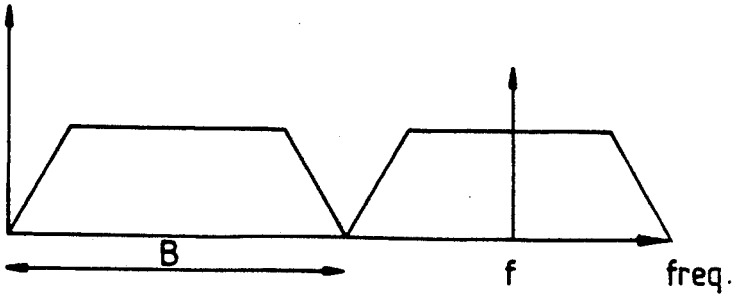

A passband filter F (FIGS. 10 and 11) centered on f enables the isolation of the product term. For this purpose, it is necessary to have $f>3B/2$ where B is the spectral range of R(t) and S(t). The influence of the constant term appearing during the integration is thus got rid of.

On each channel, during a first calibration phase, the values of $\phi_p$ are chosen such that:

$$\omega p\tau - \omega'(N\text{-}p)\tau + \omega_p = 2K\tau(k\epsilon N)$$

This approach has, however, the drawback of remaining sensitive to vibrations, unlike the approach integrating a phase conjugation. The combination of the frequency translation and of the phase conjugation, as achieved in FIG. 4, enables this problem to be overcome.

Figure 12:
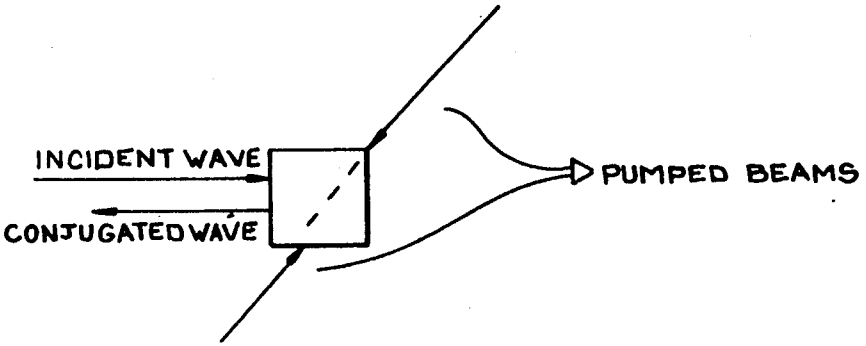
FIG. 12 shows an alternative embodiment in which the phase conjugation is done in a four-wave mixer device.

FIG. 12 shows another alternative embodiment in which the self-pumped phase conjugation mirrors MPC1 and MPC2 are replaced by phase conjugation mirrors resulting from a four-wave interaction as shown in this FIG. 12. The photoreactive material may remain the same ($BaTiO_3$). The increased complexity of the assembly is compensated for by a gain in reflectivity of the mirror. This reflectivity may indeed be greater than 1, the amplification of the conjugated wave being provided by pumped beams (also coming from $L_1$).

Figure 13:
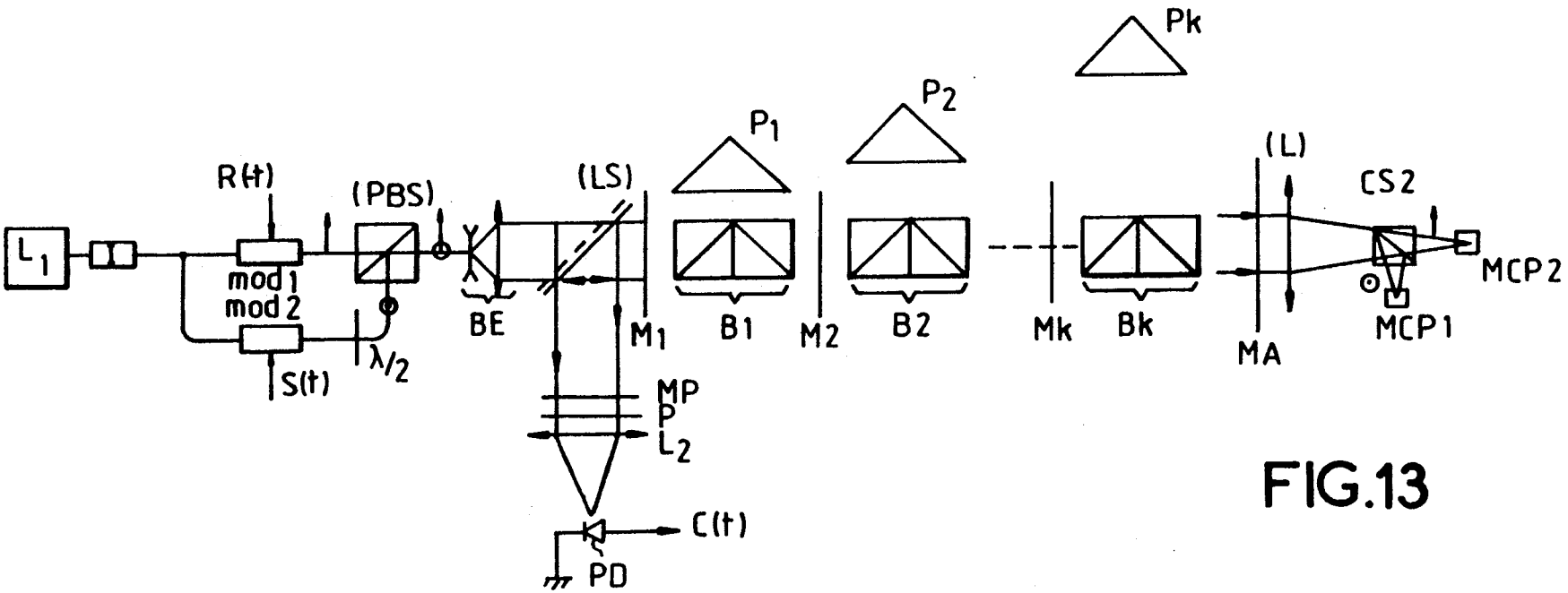

FIG. 13 shows another alternative embodiment in which the architecture of the device is identical to that proposed in FIG. 4, except in relation to the detection matrix. Furthermore, to the modulator modl there is applied not the signal R(t) but the signal R(-t) (after the memorizing of the signal on the observation time).

After the light beams have passed twice through the delay device and have been modulated by MP and after the recombining of the polarizations by P, all the channels are summed up by means of an optical device ($L_2$) on a single photodetector PD. This photodiode then delivers a photocurrent having the form:

$$C(t)\alpha < \sum_p [S_1(-t+2p\tau)]^2 > + < \sum_p [S_2(t-2(N-p)\tau)]^2 + 2\sum_p S_1(-t+2p\tau)S_2(t-2(N-p)\tau)\cos\phi_p$$

The latter term can also be written as:

$$A(t)=\Sigma_p S_1(t_i-t)S_2(t_i-2N\Sigma+t)\cos\tau_p$$

Thus, signals R(t) and S(t) are available at each instant t of the product of correlation of the signals R(t) and S(t). Furthermore, each term of the sum may be assigned a weight ranging from −1 to 1.

For signals R(t) and S(t) that vary little in the interval of the observation period, C(t) varies practically as A(t), which is the correlation product.

It is also possible to choose, as in the alternative embodiment shown in FIG. 10, to make a shift in frequency of one of the carriers so as to enable the filtering of A(t).

Figure 14:
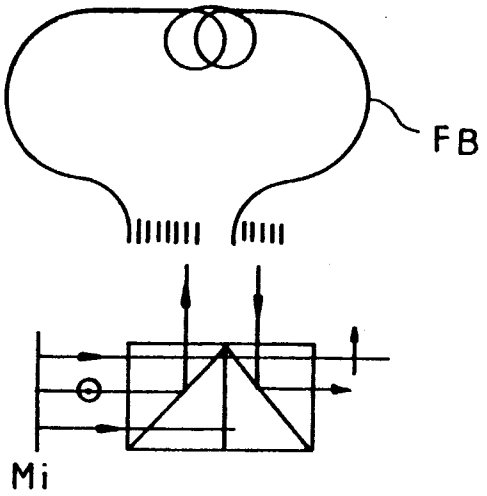
FIG. 14 shows another alternative embodiment for the creation of delays.
Figure 15:
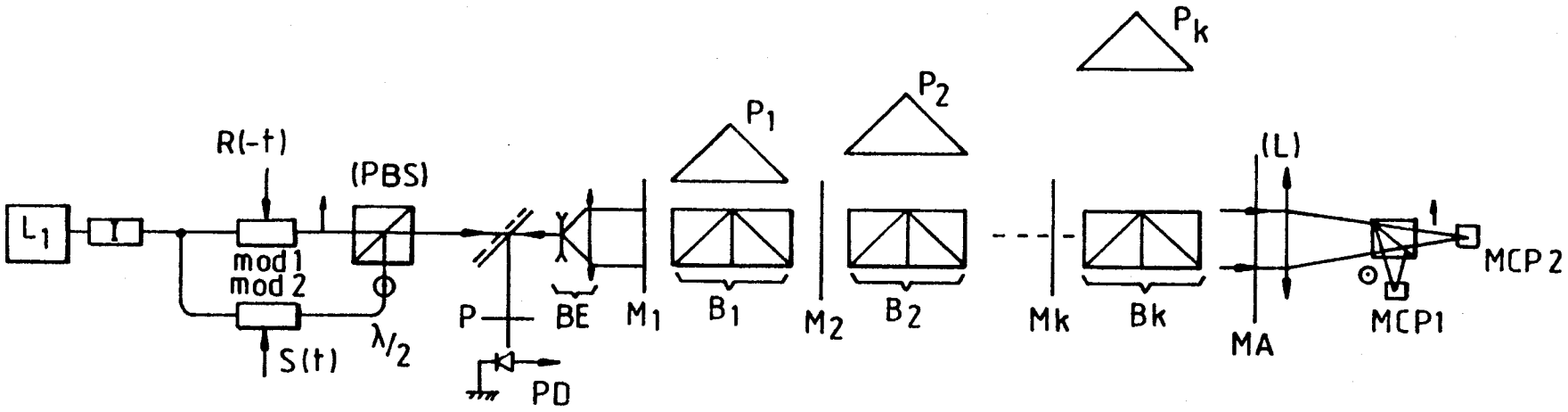
FIG. 15 shows another alternative embodiment of the device of FIG. 14.

FIG. 14 shows an alternative embodiment in which, to reduce the bulk of the device, the highest delay values may be achieved by means of bundles of optic fibers FB. In certain embodiments, these fibers will have the same length for the different channels.

According to the alternative embodiment of FIG. 14, the phase conjugation is taken advantage of in order to achieve the most efficient possible summing of the different channels. The phase modulator MP is eliminated. The different weights needed for the summing are assigned to the channels by means of MA. The a focal system BE provides for the summing, through the polarizer P, of all the channels on the photodiode PD.

It is quite clear that the above description has been given purely by way of a non-restrictive example. Other alternative embodiments may be contemplated without going beyond the scope of the invention. The types of optical elements, such as the types of liquid crystal cells, the types of polarizers and the types of polarization separators have been given purely in order to illustrate the description.

What is claimed is:

1. A method for the intercorrelation of electrical signals wherein a first light wave and a second light wave are modulated respectively by a first electrical signal and by a second electrical signal, the two waves being polarized differently and made colinear in a single light beam; then, the light beam is split into at least two channels and, in each channel, a delay is introduced on one polarization with respect to the other; finally, the channels that give the intercorrelation function are detected, and the channel that gives the maximum of the intercorrelation function enables the detection of the delay existing between the first electrical signal and the second electrical signal.

2. A method according to claim 1, wherein the two waves are polarized perpendicularly.

3. A method according to claim 2, wherein the two waves of each channel have different paths obtained by separation of polarizations and transmission of the two polarizations towards two paths of different lengths, the separation of polarizations being furthermore preceded by one of a0° and a 90° rotation of the polarizations.

4. A method according to claim 1, wherein the first and second light waves have a same wavelength.

5. A device for the intercorrelation of first and second electrical control signals, said device comprising:

a first electroptical modulator and a second electro-optical modulator respectively receiving said first electrical control signal and said second electrical control signal as well as a respective light wave, with each light wave being modulated by a respective one of said first and second electrical control signals and each light wave being polarized along an appropriate direction of polarization;

a coupling device superimposing the two modulated waves to form a single light beam;

a beam splitter device splitting the single light beam into at lest two channels;

each of said two channels associated with a respective switchable polarization rotation device;

a polarization separation device provided with each polarization rotation device and transmitting a first polarization on a first path and a second polarization on a second path for each channel;

a recombination device for recombining the first and second paths and providing an output to at least one photodetector.

6. A device according to claim 5, wherein the beam splitter device and the polarization rotation device are one and the same splitting and rotation device.

7. A device according to claim 6, wherein the splitting and rotation device is a liquid crystal cell.

8. A device according to claim 5, wherein the polarization separation device comprises:

a first polarization separation prism transmitting a first polarization and reflecting a second polarization;

a reflection device receiving the second reflected polarization and sending it on to a second polarization separation prism placed on the path of the second polarization in such a way that the second polarization is reflected and brought back colinearly with the first polarization in being thus delayed in relation to the first polarization.

9. A device according to claim 8, wherein a beam splitter device, a polarization rotation device and a polarization separation device form a delay creation assembly and wherein several delay creation assemblies are placed in series.

10. A device according to claim 9 comprising, in series with the delay creation assemblies, at least one phase conjugation mirror reflecting the different polarizations along their direction of incidence; a semi-reflecting device being located between the first delay creation assembly and the modulators.

11. A device according to claim 10, comprising a polarization separator/recombiner as well as a first photoreflective crystal phase conjugation mirror reflecting a first polarization and a second photorefractive crystal phase conjugation mirror reflecting the second polarization.

12. A device according to claim 10, wherein the phase conjugation mirror is a four-wave mixer device.

13. A device according to claim 5, wherein one of said first and second paths comprises transmission devices so that the polarization transmitted along this path travels on a predetermined path and is then brought back colinearly with the other polarization.

14. A device according to claim 5, wherein one of said first and second paths comprises one or more optic fibers.

15. A device according to claim 5, comprising a delay circuit placed in series with an output of one of the modulators.

16. A device according to claim 13, wherein the delay circuit is an optic fiber.

17. A device according to claim 5, comprising a frequency translator placed in series with one of the modulators as well as a filter placed at output of the photodetectors and filtering the information elements given by the photodetectors.

18. A device according to claim 5, wherein one of the signals is reversed in time and wherein said device comprises a single photodetector.

* * * * *